US012703898B2

(12) United States Patent
Li et al.

(10) Patent No.: US 12,703,898 B2
(45) Date of Patent: Aug. 11, 2026

(54) MCrAlX-ALLOY, POWDER, COATING FOR PROTECTION AGAINST CORROSION AND OXIDATION AND FOR BONDING CERAMIC INSULATING COATING AND COMPONENT

(71) Applicant: Siemens Energy Global GmbH & Co. KG, Munich (DE)

(72) Inventors: Xin-Hai Li, Linkoping (SE); Snezana Djordjevic, Finspong (SE)

(73) Assignee: Siemens Energy Global GmbH & Co. KG, Munich (DE)

( * ) Notice: Subject to any disclaimer, the term of this patent is extended or adjusted under 35 U.S.C. 154(b) by 24 days.

(21) Appl. No.: 18/725,783

(22) PCT Filed: Dec. 5, 2022

(86) PCT No.: PCT/EP2022/084415
§ 371 (c)(1),
(2) Date: Jun. 30, 2024

(87) PCT Pub. No.: WO2023/131452
PCT Pub. Date: Jul. 13, 2023

(65) Prior Publication Data

US 2025/0109464 A1 Apr. 3, 2025

(30) Foreign Application Priority Data

Jan. 6, 2022 (EP) ..... 22150398

(51) Int. Cl.
*C22C 19/05* (2006.01)
*B22F 1/10* (2022.01)
*B22F 1/12* (2022.01)

(52) U.S. Cl.
CPC ..... *C22C 19/056* (2013.01); *B22F 1/10* (2022.01); *B22F 1/12* (2022.01); *B22F 2301/15* (2013.01); *B22F 2999/00* (2013.01)

(58) Field of Classification Search
None
See application file for complete search history.

(56) References Cited

U.S. PATENT DOCUMENTS

2014/0220384 A1* 8/2014 Stamm ..... C22C 19/055 420/439
2016/0168667 A1* 6/2016 Li ..... C23C 14/06 428/656
2021/0123124 A1* 4/2021 Kudo ..... F01D 5/288

FOREIGN PATENT DOCUMENTS

EP 2729597 A1 5/2014

OTHER PUBLICATIONS

PCT International Search Report and Written Opinion of International Searching Authority mailed Jan. 13, 2023 corresponding to PCT International Application No. PCT/EP2022/084415 filed Dec. 5, 2022.
Nijdam, T.J. et al.: "Effect of reactive element oxide inclusions on the growth kinetics of protective oxide scales", ScienceDirect Acta Materialia 55, pp. 5980-5987 www.elsevier.com/locate/actamat.
Smialek, J. L. et al.: "Effects of hydrogen annealing, sulfur segregation and diffusion on the cyclic oxidation resistance of superalloys: a review", Thin Solid Films, pp. 285-292, Elsevier Sience S.A. ; 1994.
Simalek, J. L. : "Effect of Sulfur Removal on Al2O3 Scale Adhesion", Metallurgical Transactions A, vol. 22A, pp. 739-740, Mar. 1991.

* cited by examiner

*Primary Examiner* — Elizabeth Collister
(74) *Attorney, Agent, or Firm* — Wolter Van Dyke Davis, PLLC

(57) ABSTRACT

A MCrAlX-alloy, powder, coating for protection against corrosion and oxidation and for bonding ceramic insulating coating and component. The nickel-based alloy NiCoCrAlY includes: Cobalt (Co) 24.5%-26.5%; Chrome (Cr) 14.5%-16.5%; Aluminum (Al) 11.6%-12.6%; Yttrium (Y) 0.3%-0.5%; Iron (Fe) 4.0%-5.0%; Tantalum (Ta) 0.6%-0.8%; Molybdenum (Mo) 0.4%-0.6%; Silicon (Si) 0.4%-0.6%.

9 Claims, No Drawings

MCrAlX-ALLOY, POWDER, COATING FOR PROTECTION AGAINST CORROSION AND OXIDATION AND FOR BONDING CERAMIC INSULATING COATING AND COMPONENT

CROSS REFERENCE TO RELATED APPLICATIONS

This application is the US National Stage of International Application No. PCT/EP2022/084415 filed 5 Dec. 2022, and claims the benefit thereof, which is incorporated by reference herein in its entirety. The International Application claims the benefit of European Application No. EP22150398 filed 6 Jan. 2022.

FIELD OF INVENTION

The invention relates to a MCrAlX-alloy as a Nickel-based alloy, a powder, a coating for protection against corrosion and oxidation and a component.

BACKGROUND OF INVENTION

When further increasing engine efficiency, output power, availability, and reliability in the current gas turbine development, it is often limited by temperature capacity and lifetime of protective coatings for protection against hot corrosion and oxidation and bonding thermal barrier coating TBC on the hot turbine components. The currently used coatings in GT engines were all developed more than 10 years ago and cannot fulfil demands of further turbine development.

On the other hand, they are too expensive due to large amount of the expensive element Re etc. used.

Looking at the recent development of MCrAlX coatings worldwide, all focus on adding a large amount of rare earth elements or precious metals such as Gd, La, Pt etc. in the coatings to achieve a higher temperature capacity and longer lifetime, this trend is conflicting with the dramatic price increase of the elements in the market.

In the MCrAlX coatings available today, one relies on X=Y incorporation very much to have pegging and scavenge effects to increase oxidation and corrosion resistances of the coatings.

However, it has recently been reported that yttrium oxide inclusions in the protective aluminum oxide scale on top of MCrAlY provide fast oxygen diffusion routes, and therefore, accelerate oxidation of the coating (Nijdam T J, Sloof W G. Acta Materialia 2007; 55:5980).

High sulfur(S) content≥10 ppm existed in the current MCrAlY shortens coating lifetime (Smialek J L, Jayne D T, Schaeffer J C, Murphy W H. Thin Solid Films 1994; 253:285; and Smialek J L. Metallurgical Transactions A, Physical Metallurgy and Materials Science 1991; 22A:739).

This problem has not been solved yet. They still suffer from technical limitations and dramatic increase in price of rare earth elements.

SUMMARY OF INVENTION

It is therefore the aim of this invention to overcome these problems.

The problem is solved by an alloy, a powder, a coating, and a component according to the claims.

In the dependent claims further advantages are listed which can be combined arbitrarily to yield further advantages.

DETAILED DESCRIPTION OF INVENTION

This invention is to solve the problem by using recent research results and upgraded thermodynamic modelling to design an optimized and innovative MCrAlX alloy coating applied by means of thermal spraying in air, vacuum, or protected atmosphere, physical deposition, and plating on Ni or Co based superalloys. M stands for Ni, Co, or both of them and X is a combination of minor elements such as Y, Si, Hf, Ta, Fe, Mo, etc. instead of Y or replacing Y in the current MCrAlY coatings. It means that we will introduce other minor elements to replace part of Y functions in order to keep Y content low. This invention is also to avoid or minimize the use of the expensive elements to still meet the increased demands of today's advanced gas turbines. Introduction of Iron (Fe) stabilizes the Al rich phases in the coating and to some extent reduces consumption rate of Al.

Moreover, another approach in designing and manufacturing the innovative MCrAlX coatings is to reduce the content of Sulfur(S) to ≤10 ppm to further increase coating lifetime.

The new MCrAlX coating is a Ni-based alloy and possesses the following composition (in wt %): Ni balanced, 24.5%-26.5% Co, 14.5%-16.5% Cr, 11.6%-12.6% Al, 0.3%-0.5% Y, 4.0%-5.0% Fe, 0.4%-0.6 Mo, 0.4%-0.6% Si, 0.6%-0.8% Ta.

Especially no Rhenium (Re) or no Ruthenium (Ru) or no Titanium (Ti) or no Columbium (Nb) is added.

Introduction of Iron (Fe) allows to stabilize the Aluminum (Al) rich phases in the microstructure or in the coating and to some extent reduces consumption rate of Aluminum (Al).

Yttrium (Y) is added to the coating to improve the environmental resistance of the alloy. The Yttrium (Y) content can alternatively be increased to a level where a fine dispersion of Yttrium oxide particles can be developed in the vacuum plasma sprayed coating. The particles further aid in strengthening the coating.

Cobalt (Co) contributes to the alloy properties in at least two ways. First, it raises the solvus temperature of the gamma prime phase, permitting higher operating temperatures. Secondly, it improves stability of the gamma phase by inhibiting sigma phase precipitations.

The Chromium (Cr) content of the coating can vary from about 14.5 to about 16.5 percent. If the Chromium (Cr) content is significantly lower, the oxidation and corrosion resistance of the coating is reduced. If the Chromium (Cr) content is higher, there is an increased tendency to form the embrittling sigma phase.

The molybdenum (Mo) aids in solid solution strengthening of the gamma and gamma prime phases.

Tantalum (Ta) partitions to, and reacts to form, the gamma prime phase.

Aluminum (Al) is the primary gamma prime forming element and contributes to oxidation resistance.

Yttrium (Y) is present in the coating in an amount to about 0.5 wt %. Yttrium (Y) in a small amount improves oxidation resistance. If the amount of Yttrium (Y) is above about 0.3 wt %, some Yttrium (Y) may oxidize during vacuum plasma spraying to form small Yttrium oxide particles in the coating that improve the strength by dispersion strengthening.

Silicon (Si) increases oxidation and corrosion resistance.

This invention results in MCrAlX coatings with a higher temperature capacity, longer life, and lower cost than the MCrAlX coatings available today.

The coating thickness should be in the range of 30 μm-800 μm depending on type of applications and application methods.

This invention results in NiCoCrAlX based coatings with a higher temperature capacity, longer life, and lower cost than the NiCoCrAlX coatings available today.

A powder with this alloy composition can be mixed with a binder and/or refractory metals or ceramics if used as an abrasive coating.

For turbine application especially a metallic substrate like a nickel or cobalt based superalloy is used on which the inventive coating is applied on.

The coating of NiCoCrAlX is applied especially by a thermal spray process, like APS, VPS or HVOF.

Even SLM, SLS or any AM technique is possible to apply coatings or even to produce bulk components of this alloy.

A component at least comprises a metallic substrate, especially a Nickel based superalloy and at least a coating with the inventive alloy and optionally at least one ceramic layer on top of the metallic bond and oxidation coating, preferably with a TGO in between.

The ceramic layer(s) comprises preferably a Zirconia based composition, partly or fully stabilized.

The invention claimed is:

1. A nickel-based alloy, consisting of (in wt %):

| | |
|---|---|
| Cobalt (Co) | 25.5% |
| Chrome (Cr) | 15.5% |
| Aluminum (Al) | 12.1% |
| Iron (Fe) | 4.5% |
| Tantalum (Ta) | 0.7%, |
| Molybdenum (Mo) | 0.5% |
| Silicon (Si) | 0.5% |
| Sulfur (S) | ≤10 ppm, |
| no Rhenium (Re) or Ruthenium (Ru), and a balance of Nickel (Ni). | |

2. A powder, comprising:

an alloy according to claim 1, optionally comprising a binder and/or hard or ceramic particles.

3. A coating, having a composition of an alloy according to claim 1, comprising a thickness in a range of 30 μm to 800 μm.

4. A component, comprising at least a metallic substrate comprising a Nickel-based or Cobalt-based superalloy, a metallic coating with a composition according to claim 1, and a ceramic coating above the metallic substrate and the metallic coating.

5. The component according to claim 4, wherein the ceramic coating comprises a Zirconia based composition, partly or fully stabilized.

6. A coating produced with a power of claim 2, comprising a thickness in a range of 30 μm to 800 μm.

7. A component, comprising at least a metallic substrate comprising a Nickel-based or Cobalt-based superalloy, the coating according to claim 3, and a ceramic coating above the metallic substrate and the coating.

8. A nickel-based alloy, consisting of (in wt %):

| | |
|---|---|
| Cobalt (Co) | 24.5%-26.5% |
| Chrome (Cr) | 14.5%-16.5% |
| Aluminum (Al) | 11.6%-12.6% |
| Hafnium (Hf) | 0.3%-0.5% |
| Iron (Fe) | 4.0%-5.0% |
| Tantalum (Ta) | 0.6%-0.8% |
| Molybdenum (Mo) | 0.4%-0.6% |
| Silicon (Si) | 0.4%-0.6% |
| Sulfur (S) | ≤10 ppm, |
| no Rhenium (Re) or Ruthenium (Ru), and a balance of Nickel (Ni). | |

9. A nickel-based alloy, consisting of (in wt %):

| | |
|---|---|
| Cobalt (Co) | 24.5%-26.5% |
| Chrome (Cr) | 14.5%-16.5% |
| Aluminum (Al) | 11.6%-12.6% |
| Iron (Fe) | 4.0%-5.0% |
| Tantalum (Ta) | 0.6%-0.8% |
| Molybdenum (Mo) | 0.4%-0.6% |
| Silicon (Si) | 0.4%-0.6% |
| Sulfur (S) | ≤10 ppm, |
| no Rhenium (Re) or Ruthenium (Ru), and a balance of Nickel (Ni). | |

* * * * *